US006906471B2

(12) United States Patent
Roh et al.

(10) Patent No.: US 6,906,471 B2
(45) Date of Patent: Jun. 14, 2005

(54) ENERGY RECOVERY APPARATUS AND METHOD FOR PLASMA DISPLAY PANEL

(75) Inventors: Chung-wook Roh, Seoul (KR); Sang-Hoon Lee, Seoul (KR); Hye-jeong Kim, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 13 days.

(21) Appl. No.: 10/449,765

(22) Filed: Jun. 2, 2003

(65) Prior Publication Data

US 2003/0222864 A1 Dec. 4, 2003

(30) Foreign Application Priority Data

Jun. 4, 2002 (KR) ..... 10-2002-0031293

(51) Int. Cl.[7] ..... G09G 3/10

(52) U.S. Cl. ..... 315/169.4; 345/211; 345/60; 345/66

(58) Field of Search ..... 315/161, 169.4; 345/204, 211, 37, 41–42, 60, 214, 66

(56) References Cited

U.S. PATENT DOCUMENTS 4,866,349 A * 9/1989 Weber et al. ..... 315/169.4
5,081,400 A * 1/1992 Weber et al. ..... 315/169.4
5,642,018 A * 6/1997 Marcotte ..... 315/169.4
5,828,353 A * 10/1998 Kishi et al. ..... 345/55
6,150,999 A * 11/2000 Chen et al. ..... 345/60
6,657,604 B2 * 12/2003 Huang et al. ..... 345/60
6,850,213 B2 * 2/2005 Marcotte ..... 345/60

* cited by examiner

*Primary Examiner*—Thuy Vinh Tran
(74) *Attorney, Agent, or Firm*—Sughrue Mion, PLLC

(57) ABSTRACT

Provided are an energy recovery apparatus and method for recovering energy in a plasma display panel (PDP) at improved efficiency using a single energy storage device and a small number of devices regardless of the number of pixels that become conductive as a result of the screen state. The energy recovery apparatus includes a first closed circuit, which supplies predetermined source voltage to pixels for conduction according to a predetermined switching sequence; a second closed circuit, which uses a single energy storage device to recover energy discharged from the pixels that have been charged by the first closed circuit; and a third closed circuit, which transfers the energy stored in the energy storage device to pixels for conduction according to the predetermined switching sequence.

25 Claims, 10 Drawing Sheets

ENERGY RECOVERY APPARATUS AND METHOD FOR PLASMA DISPLAY PANEL

CROSS-REFERENCE TO RELATED APPLICATIONS

This application claims the priority of Korean Patent Application No. 2002-31293, filed on Jun. 4, 2002, in the Korean Intellectual Property Office, the disclosure of which is incorporated herein in its entirety by reference.

BACKGROUND OF THE INVENTION

1. Field of the Invention

The present invention relates to an apparatus and method for driving a plasma display panel (PDP), and more particularly, to an energy recovery apparatus and method for recovering energy in a PDP at improved efficiency using a single energy storage device and a small number of devices regardless of the number of pixels that become conductive as a result of the screen state.

2. Description of the Related Art

A PDP is a next generation display apparatus, which displays characters and images using plasma that is generated due to gas discharge. A PDP includes hundreds of thousands to millions of pixels in a matrix, depending on its size.

A sequence of driving a PDP is divided into a reset period, an address period, and a sustain period. During the reset period, all cells are discharged and simultaneously wall charges are eliminated, so that hysteresis regarding the display is eliminated. During the address period, an address discharge is performed in cells selected according to a matrix structured by combining row and column electrodes of the PDP. During the sustain period, an image is displayed while a discharge, determined for each cell during a scan period, alternates with energy recovery.

During the address period and the sustain period, an energy recovery apparatus is used in order to reduce power consumption.

FIG. 1 shows a conventional energy recovery apparatus used for a PDP during the address period. In other words, FIG. 1 shows a conventional energy recovery apparatus applied to an address driving circuit 100 of a PDP. In a PDP, each column electrode can be assumed to carry a load of capacitance Ca. During the address period, a load is represented with a variable load from 0 to nCa (where "n" is the number of pixels turned on per electrode row, i.e., an address electrode). An address energy recovery operation performed by an energy storage device, i.e., a capacitor C1, and an inductor L1 can be divided into four modes as follows. The four modes will be described with reference to a switch timing chart and waveform diagrams shown in FIGS. 2A through 2H.

1) Mode 1 (M1)

Before a MOSFET switch S1 is turned on, a switch S4 is turned on and voltage at both ends of each address electrode is sustained at Vp=Vo(1)=Vo(2)= . . . =Vo(n)=0. When the switch S1 is turned on at the beginning of a time period t0, mode 1 (M1) starts. During mode 1, an LC resonance circuit is formed on a path C1-S1-D1-L1-Su (pixel to be conducted)-Ca (pixel to be conducted). Accordingly, resonance current flows in the inductor L1, and thus an address electrode voltage Vp increases. At the beginning of a time period t1, the current of the inductor L1 is 0 A, and Vp=+Va.

2) Mode 2 (M2)

At the beginning of the time period t1, a switch S3 is turned on. During mode 2 (M2), Vp=+Va, and wall charges are accumulated in each address electrode depending on the conditions of an image.

3) Mode 3 (M3)

At the beginning of a time period t2, a switch S2 is turned on, and the switches S1 and S3 are turned off. Accordingly, during mode 3 (M3), an LC resonance circuit is formed on a path Ca (pixel to be conducted)-Su (pixel to be conducted)-L1-D2-S2-C1, resonance current flows in the inductor L1, and the voltage Vp decreases. At the beginning of a time period t3, the current of the inductor L1 is 0 A, and Vp=0.

4) Mode 4 (M4)

At the beginning of a time period t3, the switch S4 is turned on. During mode 4 (M4), Vp=0. When the switches S2 and S4 are turned off and the switch S1 is turned on at the beginning of a time period t4, another cycle starts.

Here, the value of the inductor L1 for energy recovery is determined by the following formula.

$$L1 = \frac{(t_2 + t_4)^2}{4\pi^2 nCa}.$$

For example, when t2+t4=200 ns, Ca=66.5 pF, and n=1248 (the number of address electrodes of a high-definition (HD) PDP), the value of the inductor L1 for satisfactory energy recovery is 12.2 nH according to the above formula. However, an inductance value below 100 nH is difficult to realize because of, for example, the leakage inductance of a printed circuit board (PCB). When the value of the inductor L1 is set to about 100 nH, and "n" is large, as shown in FIG. 2H, a voltage rapidly changes by Vst. As a result, address energy cannot be recovered. In order to solve this problem, a plurality of address energy recovery apparatuses, each similar to the one shown in FIG. 1, must be used. However, use of the plurality of address energy recovery apparatuses increases the number of components in a PDP driving system, thereby increasing manufacturing cost. In addition, the number of signal lines increases, causing PCB design to become very complicated.

SUMMARY OF THE INVENTION

The present invention provides an energy recovery apparatus and method for a plasma display panel (PDP), through which energy recovery rate can be improved using an inductor as the energy storage device of an energy recovery circuit and a small number of circuit devices.

According to an aspect of the present invention, there is provided an energy recovery apparatus in a plasma display panel driving system. The energy recovery apparatus includes a first closed circuit, which supplies a predetermined source voltage to pixels for conduction according to a predetermined switching sequence; a second closed circuit, which uses a single energy storage device to recover energy discharged from the pixels that have been charged by the first closed circuit; and a third closed circuit, which transfers the energy stored in the energy storage device to pixels for conduction according to the predetermined switching sequence.

According to another aspect of the present invention, there is provided an energy recovery apparatus in a plasma display panel driving system including an address driving circuit that switches on a charge and discharge sequence of pixels during an address period. The energy recovery apparatus includes a first switch, a second switch, an energy storage device, a third switch, a first diode, and a second diode. The first switch includes an input terminal connected to a predetermined power supply and an output terminal connected to the address driving circuit. The second switch includes a first terminal connected to the output terminal of the first switch and a second terminal connected to the energy storage device, and switches on or off current discharged from the pixels or energy transmitted through the first switch according to a predetermined sequence. The energy storage device is connected between the second terminal of the second switch and a first terminal of the third switch. The third switch includes the first terminal connected to the energy storage device and a second terminal connected to ground. The first diode is connected between the second terminal of the second switch and ground. The second diode is connected to the output terminal of the first switch and the first terminal of the third switch.

According to still another aspect of the present invention, there is provided an energy recovery method for a plasma display panel driving system. The energy recovery method includes supplying a predetermined source voltage to pixels for conduction according to a predetermined switching sequence in a first mode; increasing current flow in an energy storage device, while supplying the predetermined source voltage to the pixels, according to a predetermined switching sequence in a second mode; recovering energy discharged from the pixels using the energy storage device according to the predetermined switching sequence in a third mode; terminating a charge and discharge process of the pixels and sustaining the energy recovered by using the energy storage device according to a predetermined switching sequence in a fourth mode; and transferring the energy stored in the energy storage device to pixels for conduction according to a predetermined switching sequence in a fifth mode.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

For clarity of the description, the assumption is made that an energy recovery apparatus according to the present invention is applied to an address driving circuit of a plasma display panel (PDP). The present invention can be applied to the X-electrode driving circuit and the Y-electrode driving circuit of a PDP during a sustain period, as well as the address driving circuit of the PDP.

Figure 1:
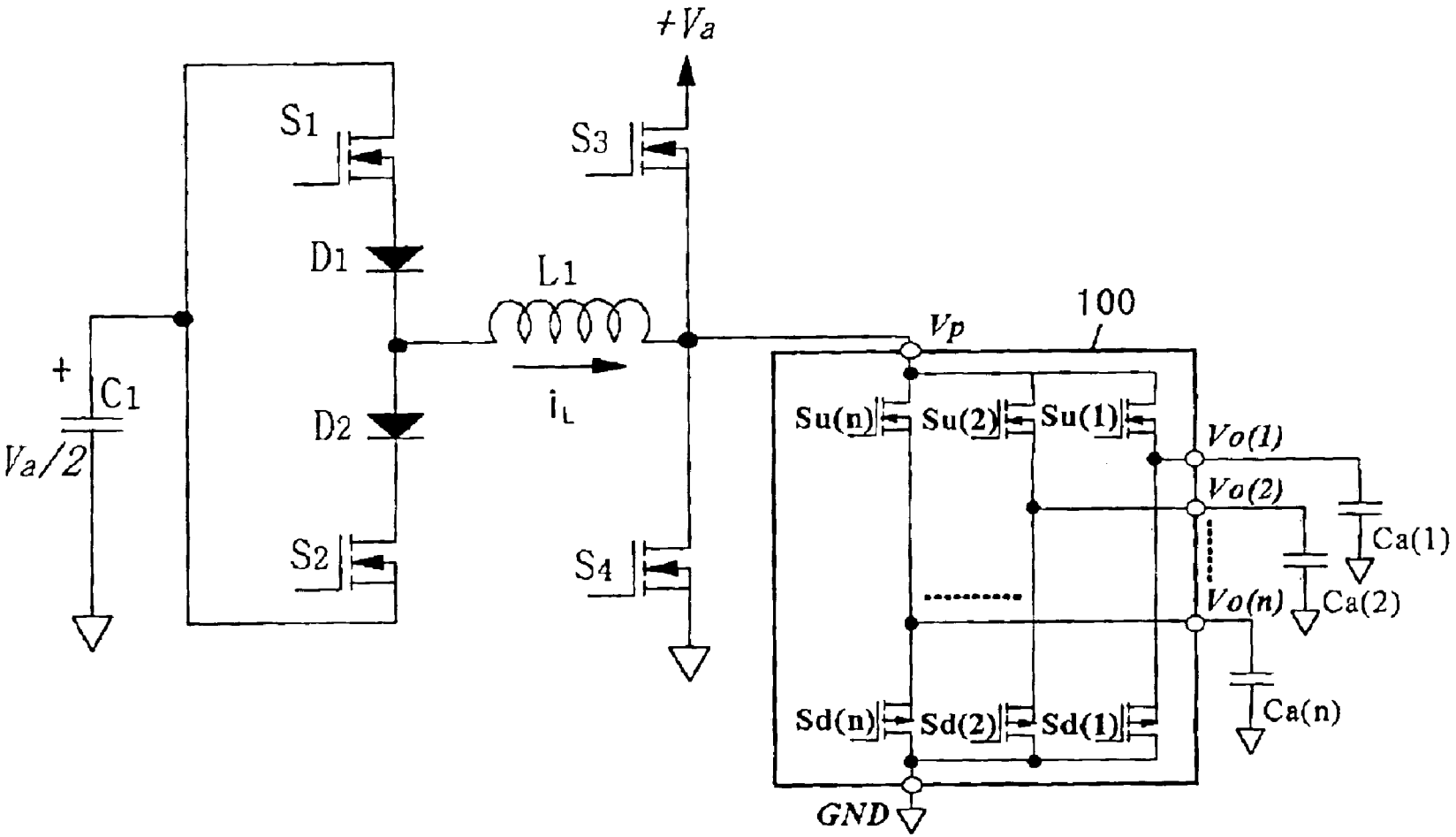
FIG. 1 (PRIOR ART)
FIG. 1 is a diagram showing the structure of a conventional energy recovery apparatus for the address electrodes of a plasma display panel (PDP)
Figure 2:
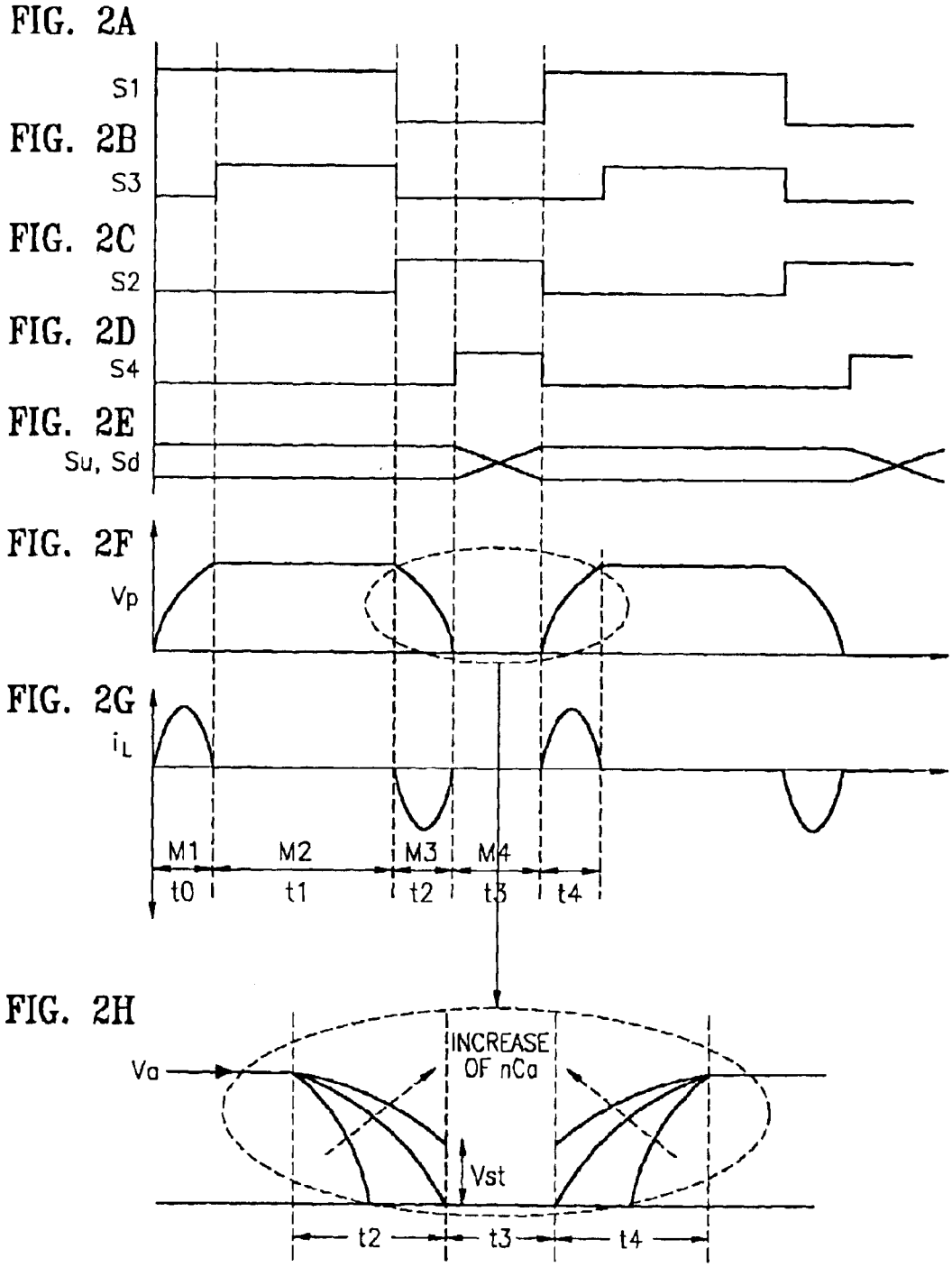
FIG. 2 (PRIOR ART)
FIGS. 2A through 2H are diagrams showing the waveforms of the main signals used in the conventional energy recovery apparatus shown in FIG. 1.
Figure 3:
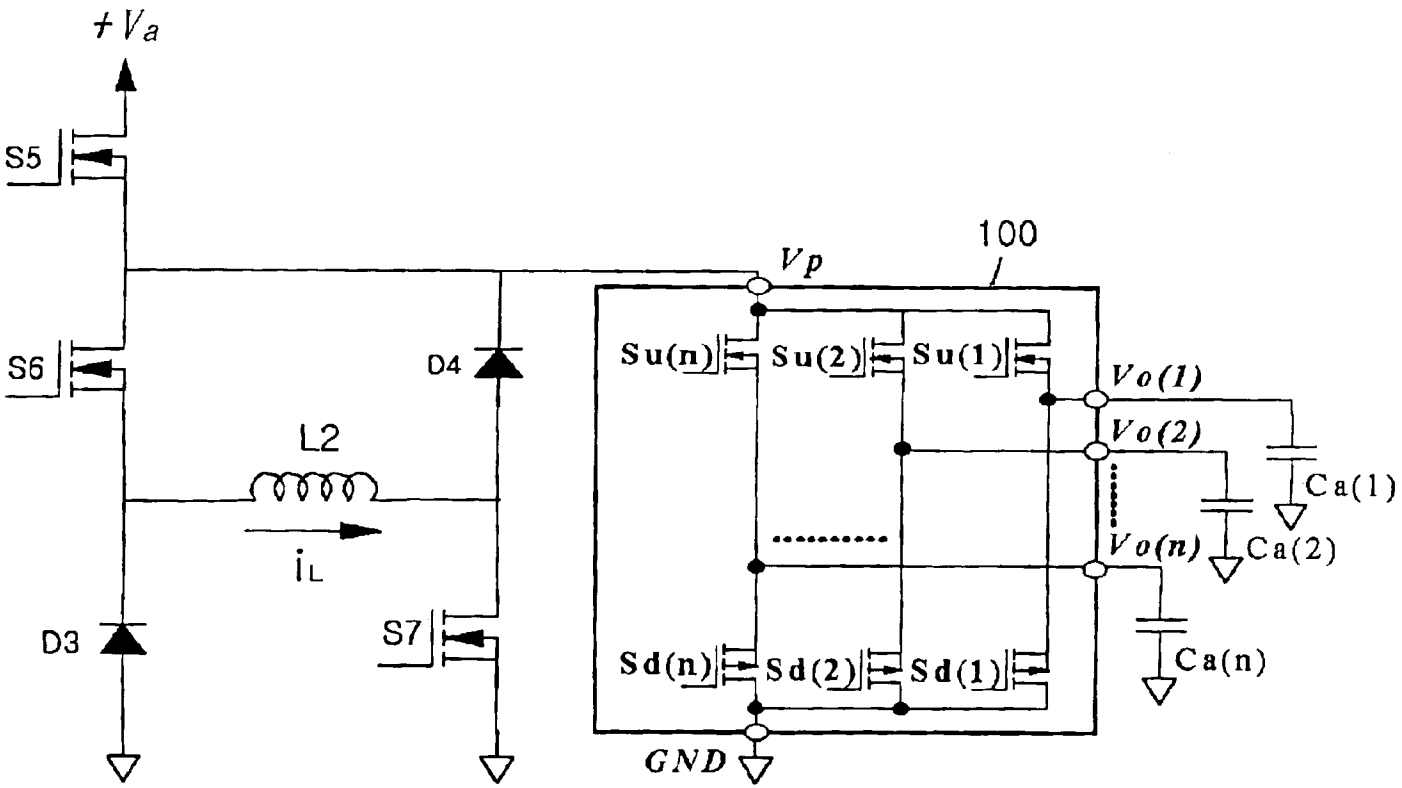
FIG. 3 is a diagram showing the structure of an energy recovery apparatus for a PDP according to an embodiment of the present invention.
Figures 4A, 4B, 4C, 4D, 4E, 4F:
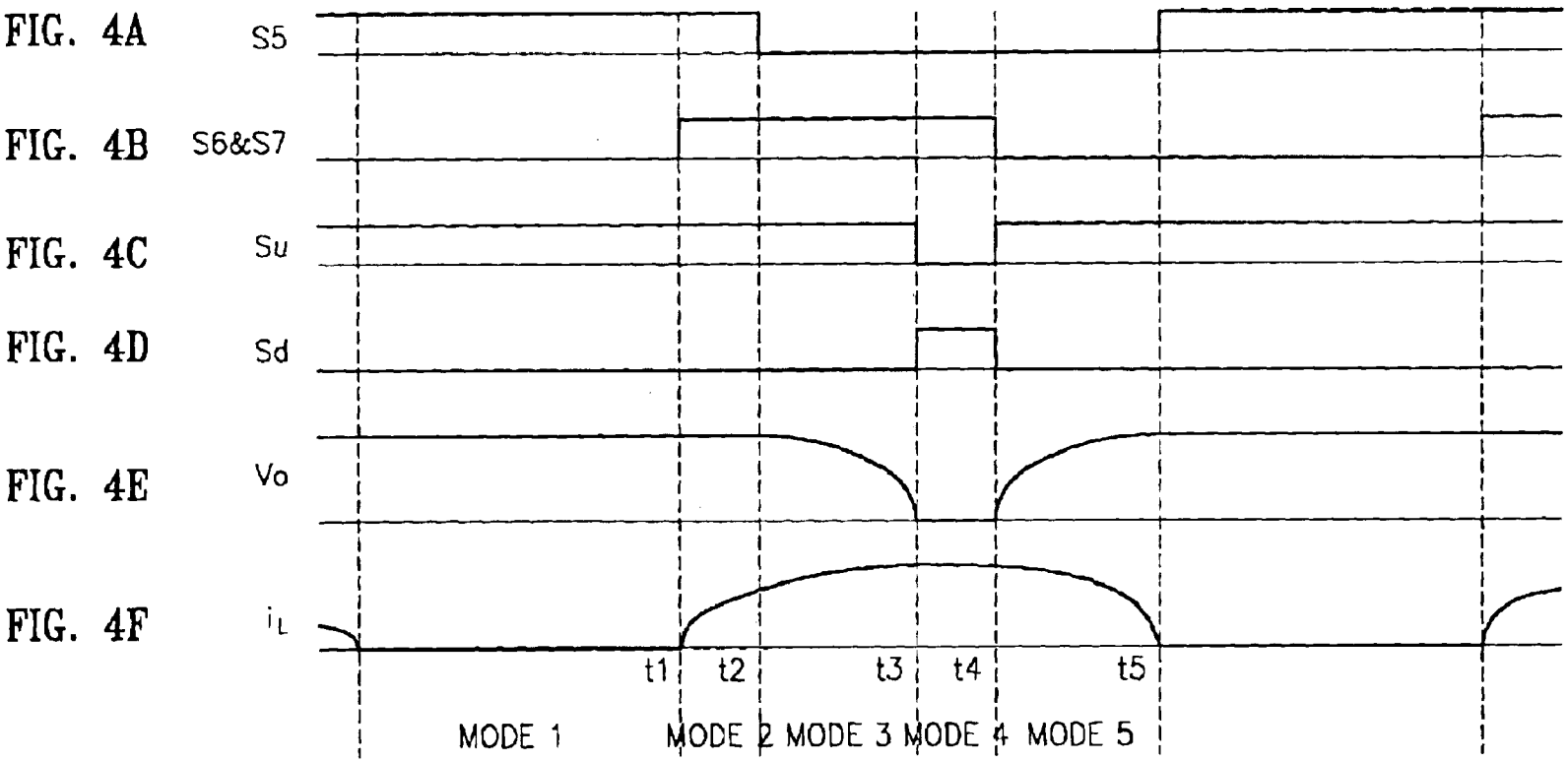
FIGS. 4A through 4F are diagrams showing the waveforms of the main signals generated in a PDP driving and switching sequence applied to an energy recovery apparatus according to the present invention.

FIG. 3 is a diagram showing the structure of an energy recovery apparatus applied to an address driving circuit 100 of a PDP according to an embodiment of the present invention. The energy recovery apparatus of the present invention shown in FIG. 3 uses a single inductor L2 as an energy storage device, unlike the conventional energy recovery apparatus that uses two energy storage devices, i.e., the capacitor C1 and the inductor L1, as shown in FIG. 1. In addition, the number of switching devices is decreased by 1 when compared to the conventional energy recovery apparatus.

The principle of operation of the energy recovery apparatus of the present invention will be detailed using mode descriptions, with reference to FIGS. 4A through 4F, which show the waveforms of switching signals, a main voltage, and a main current, and FIGS. 5A through 5E, which show the current flows in different modes.

1) Mode 1

Figure 5A:
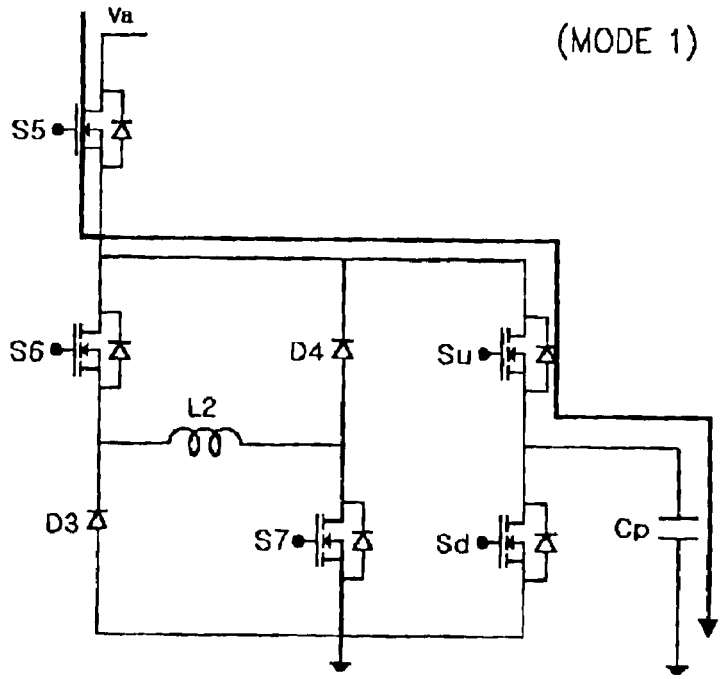
FIGS. 5A through 5E are diagrams showing the flow of current in each mode when using an energy recovery method for a PDP according to an embodiment of the present invention.
Figure 5B:
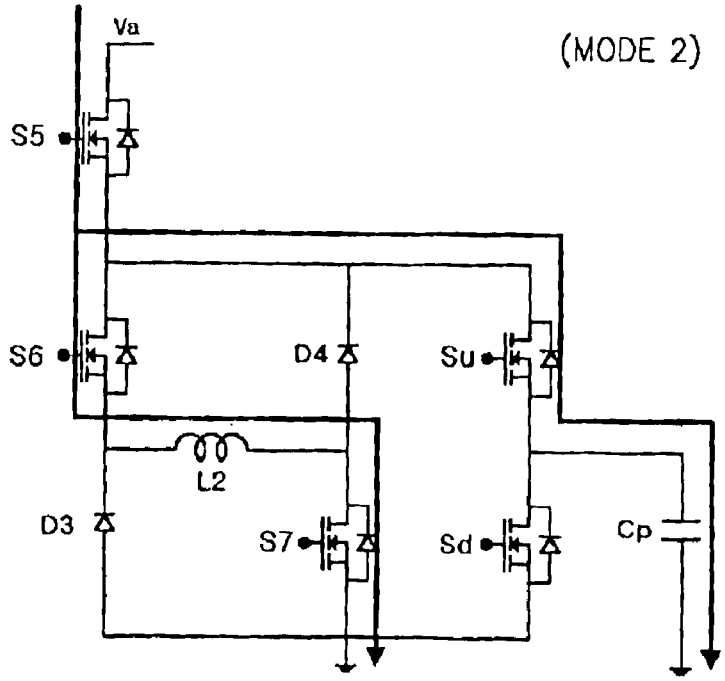

As shown in mode 1 of FIG. 5A, switches S5 and Su are turned on, and a voltage Vp applied to a selected address electrode is maintained at +Va, so that wall charges are induced in the selected address electrode (where a load is nCa). Here, a current in the inductor L2 is 0. Duration of mode 1 is determined in accordance with the address discharge characteristics of a PDP and usually exceeds 1.6 $\mu$s.

2) Mode 2

When t=t1, switches S6 and S7 are turned on. Vp=+Va, and a current $i_L$ in the inductor L2 linearly increases at a slope of +Va/L2. A duration D*Ts of mode 2 is changed depending on the conditions of a screen. Here, D is a duty of mode 2, and Ts is the time period of a single cycle from mode 1 to mode 5. When t=t2, a current $i_L$(t2) in the inductor L2 is expressed by Formula (1).

$$i_L(t2) = \frac{V_a * D * T_s}{L_2} \tag{1}$$

In the mode 2, an initial transient current is applied to the inductor L2 in the same direction as the current direction during energy recovery mode, i.e., mode 3, so that energy recovery is accomplished smoothly due to the initial transient current in the inductor L2.

3) Mode 3

Figure 5C:
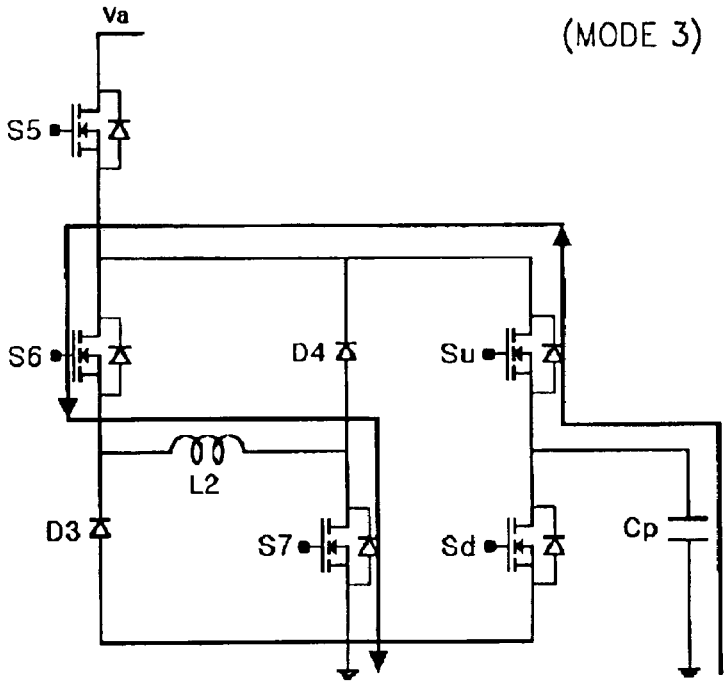
Figure 5D:
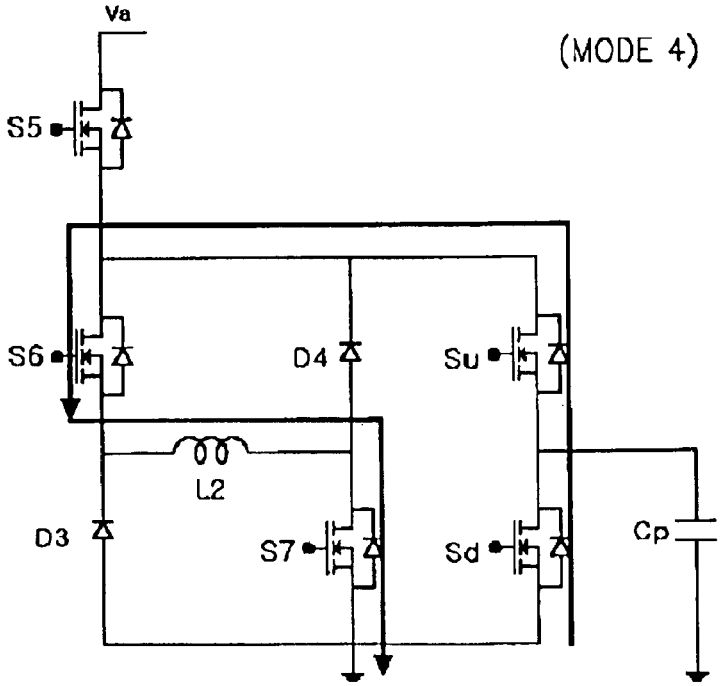

When t=t2, the switch S5 is turned off. Then, as shown in FIG. 5C, the charged energy of pixels corresponding to the selected address electrode is transferred to the inductor L2 along a resonance path nCa-Su-S6-L2-S7, thereby starting energy recovery. The current $i_L$ and the voltage Vp in the inductor L2 during mode 3 are expressed by Formulae (2) and (3), respectively.

$$i_L(t) = \frac{V_a DT_s}{L_2}\cos\omega_n(t-t_2) + \frac{V_a}{Z_n}\sin\omega_n(t-t_2) \quad (2)$$

$$V_p(t) = V_a\cos\omega_n(t-t_a) - \frac{V_a DT_s}{L_2}Z_n\sin\omega_n(t-t_2) \quad (3)$$

Here, $\omega_n = \frac{1}{\sqrt{nL_2C_a}}$, and $Z_n = \sqrt{\frac{L_2}{nC_p}}$.

Unlike the conventional energy recovery apparatus, the present invention accomplishes energy recovery by adjusting the duration of mode 2 even if "n" is large due to an existence of $i_L$(t2) and the value of the inductor L2 exceeds 100 nH, which can occur in an energy recovery circuit.

4) Mode 4

When t=t3, a switch Sd is turned on, the switch Su is turned off, the voltage Vp is maintained at 0, and the current $i_L$ flows along a path Sd-Su (body diode)-S6-L2-S7. During mode 4, a current $i_L$(t3) in the inductor L2 remains constant. Usually, switch timing during mode 4 is set small to accomplish high-speed addressing.

5) Mode 5

Figure 5E:
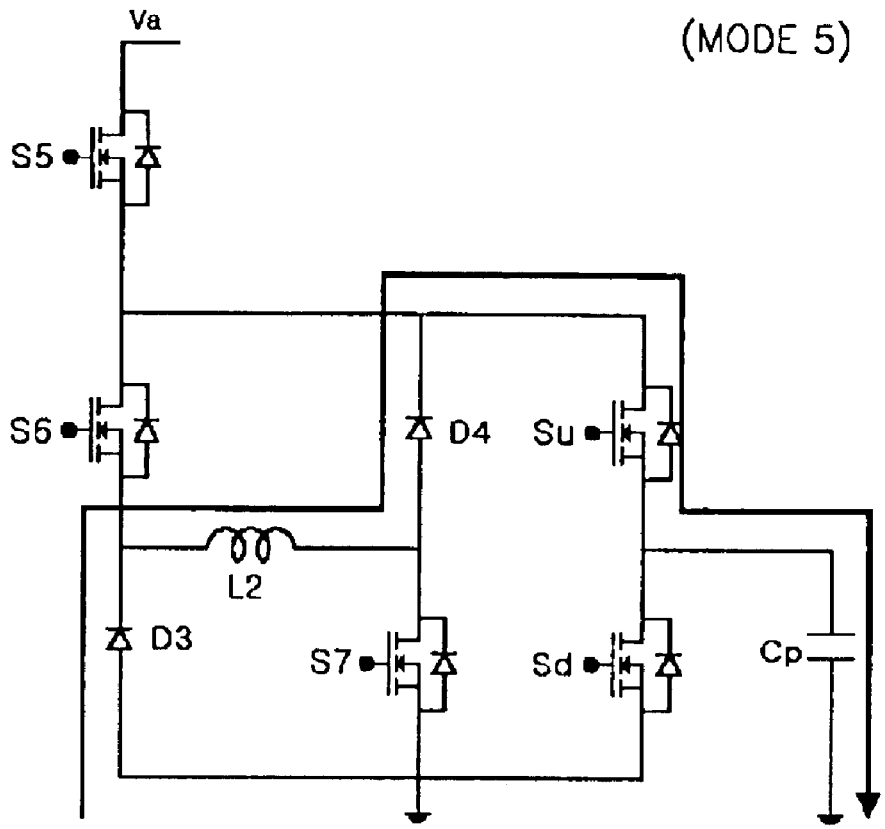

When t=t4, the switches S6 and S7 are turned off. Accordingly, as shown in FIG. 5E, energy stored in the inductor L2 is transferred to the selected address electrode along a resonance path D3-L2-D4-Su-nCa. During mode 5, the current $i_L$ and the voltage Vp in the inductor L2 are expressed by Formulae (4) and (5), respectively.

$$i_L(t)=i_L(t_3)\cos\omega_n(t-t_4) \quad (4)$$

$$V_p(t)=-i_L(t_3)Z_n\sin\omega_n(t-t_4) \quad (5)$$

The energy recovery apparatus can be designed such that the address electrode voltage Vp increases exactly to Va, by appropriately increasing the current $i_L$(t3), that is, by extending the duration of mode 2. Thereafter, when the switch S5 is turned on, another cycle starts from mode 1 again.

According to such an operation, energy recovery for a PDP can be performed exactly using only a single energy storage device, i.e., an inductor, and a small number of circuit devices, regardless of the screen condition (i.e., the number "n" of pixels turned on).

Figure 6:
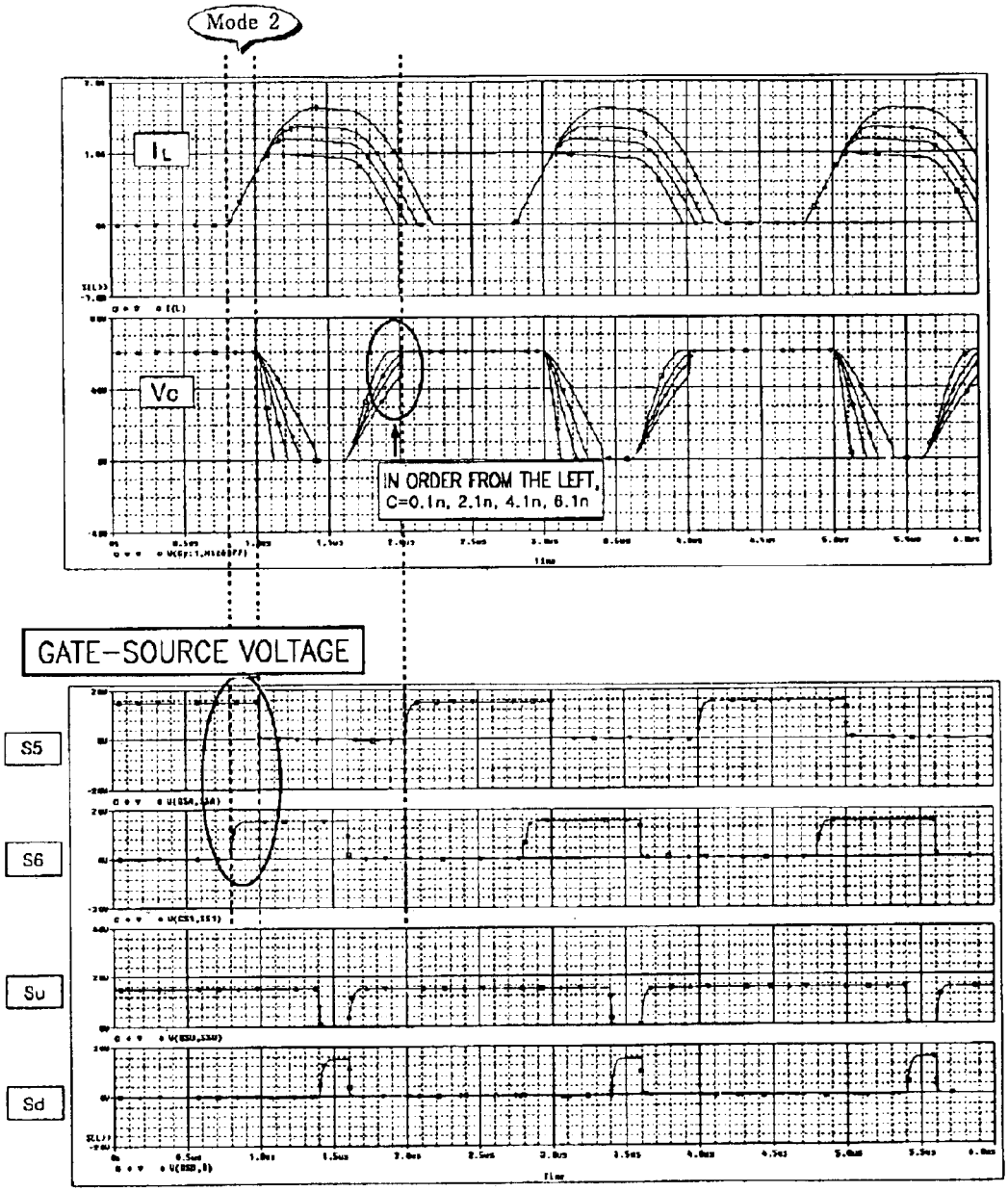
FIG. 6 is a graph showing the main voltage and current waveforms resulting from simulations in which the present invention is applied to a PDP driving system operating in mode 2 for a short period of time.
Figure 7:
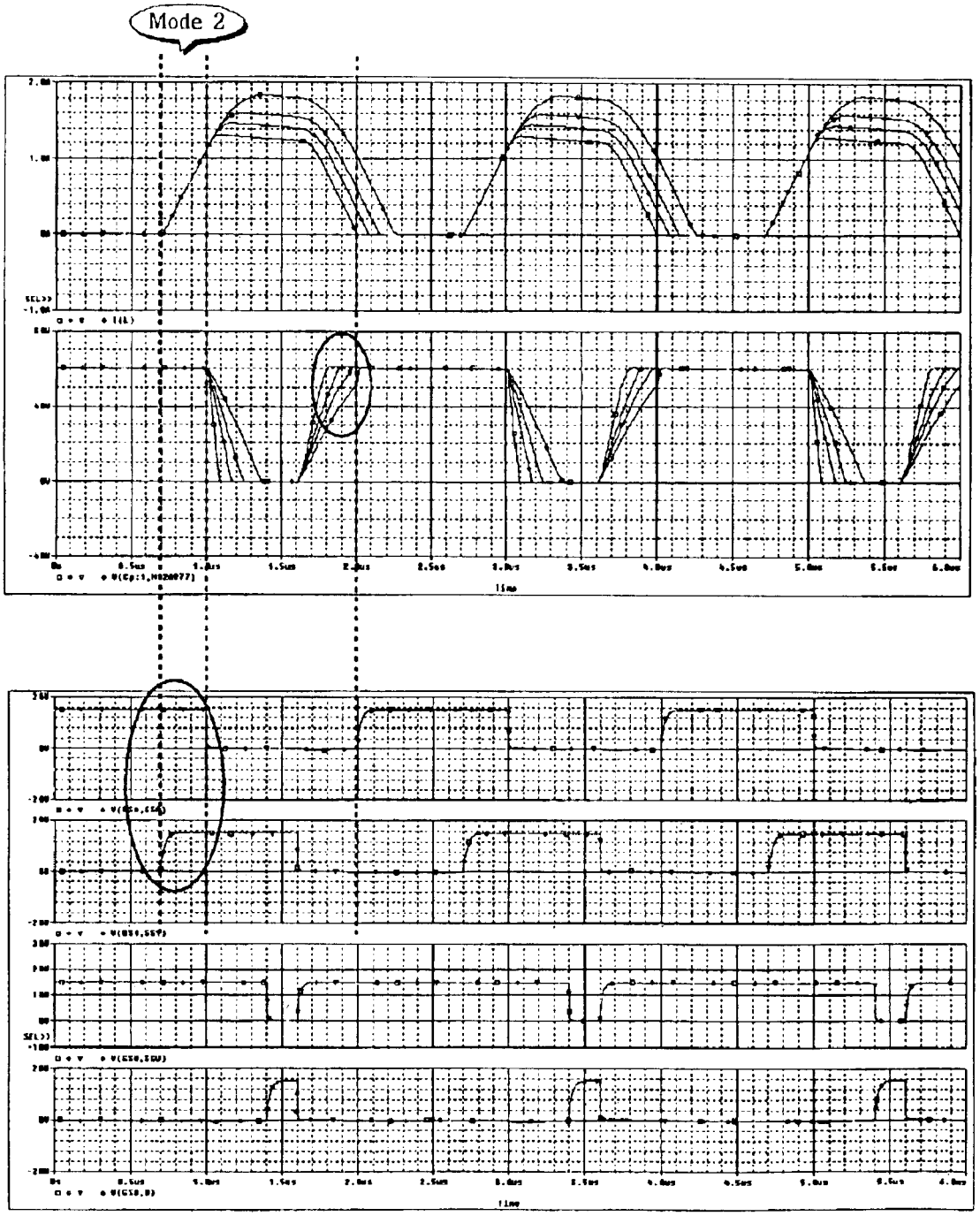
FIG. 7 is a graph showing the main voltage and current waveforms resulting from simulations in which the present invention is applied to a PDP driving system operating in mode 2 for a modest period of time.
Figure 8:
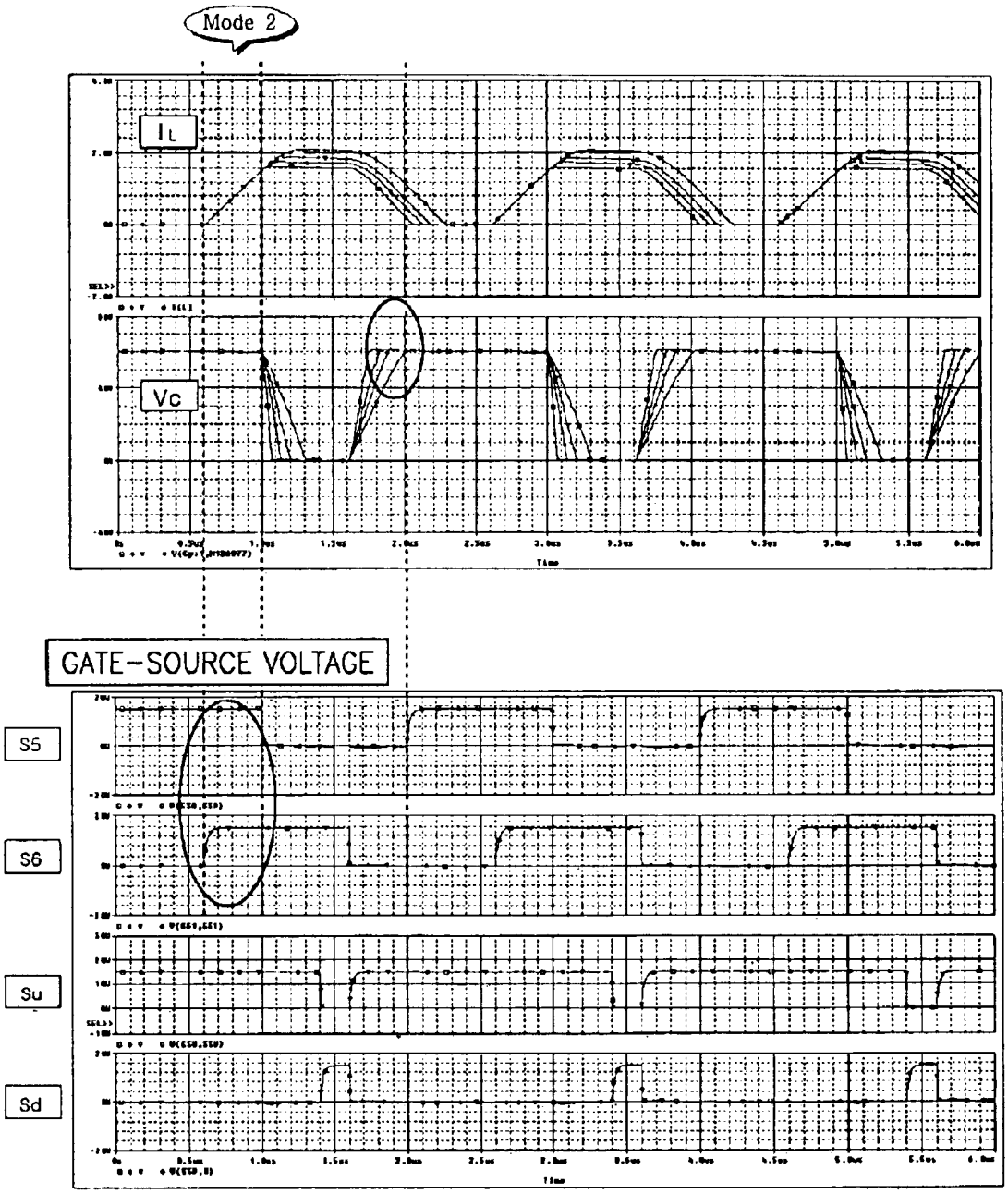
FIG. 8 is a graph showing main voltage and current waveforms resulting from simulations in which the present invention is applied to a PDP driving system having a mode 2 for a long period of time.

FIGS. 6 through 8 show the results of Pspice simulations when t2+t4=200 ns, Ca=66. 5 pF, n (the number of pixels turned on in address electrodes in a high-definition PDP)= 1248, and the value of the inductor L2 for energy recovery was set to 100 nH. An inference is made from FIGS. 6 through 8 that address energy can be satisfactorily recovered by appropriately expanding the duration of mode 2 even when "n" is large.

As described above, the present invention allows an energy recovery apparatus to be designed using only an inductor with a feasible capacity as an energy storage device, so that the structure of the energy recovery apparatus is simplified. In addition, energy can be satisfactorily recovered even when the number of conducted electrodes increases. Moreover, since energy recovery for a plurality of address driver circuits can be performed with only a single energy recovery apparatus, the structure of the energy recovery apparatus is simplified, and a printed circuit board (PCB) can be easily designed.

The present invention can be realized as a method, an apparatus, a system and so on. When the present invention is realized as software, the elements of the present invention are code segments which execute the necessary operations. Programs or code segments may be stored in a processor readable medium, or may be transmitted by a transmission medium or by a computer data signal combined with a carrier in a communication network. The processor readable medium may be any medium, such as an electronic circuit, a semiconductor memory device, a ROM, a flash memory, an $E^2$PROM, a floppy disc, an optical disc, a hard disc, an optical fiber medium, or a radio frequency (RF) network, which can store or transmit information. The computer data signal may be any signal which can be transmitted through a transmission medium such as an electronic network channel, an optical fiber, air, an electromagnetic field, or an RF network.

The present invention is not restricted to the above-described embodiments, and it will be apparent that various changes can be made by those skilled in the art without departing from the spirit of the invention. Therefore, the scope of the invention is not restricted to the specific structure and arrangement described above.

What is claimed is:

1. An energy recovery apparatus in a plasma display panel driving system, the energy recovery apparatus comprising:

a first closed circuit, which supplies a predetermined source voltage to pixels for conduction according to a predetermined switching sequence;

a second closed circuit, which uses a single energy storage device to recover energy discharged from the pixels that have been charged by the first closed circuit; and a third closed circuit, which transfers the energy stored in the energy storage device to pixels for conduction according to the predetermined switching sequence.

2. The energy recovery apparatus of claim 1, wherein the energy storage device comprises an inductor.

3. The energy recovery apparatus of claim 1, further comprising a fourth closed circuit, which supplies current to the energy storage device for a predetermined period of time before an energy recovery mode in the same direction as current flow during the energy recovery mode.

4. The energy recovery apparatus of claim 3, wherein the fourth closed circuit comprises a power supply, a first switch, an inductor, a third switch, and ground, which are connected in sequence.

5. The energy recovery apparatus of claim 1, further comprising a fifth closed circuit, which sustains the energy recovered in the energy storage device for a predetermined period of time before the energy is supplied to the pixels for conduction.

6. The energy recovery apparatus of claim 5, wherein the fifth closed circuit comprises a fifth switch connected to the pixels, a fourth switch connected to the pixels, a second switch,an inductor, a third switch, and ground, which are connected in sequence.

7. The energy recovery apparatus of claim 1, wherein the first closed circuit comprises:

a first switch, which comprises an input terminal connected to the predetermined source voltage and determines whether to output the predetermined source voltage tbrough an output terminal in accordance with the predetermined switching sequence; and a plurality of fourth switches, each of which comprises a first terminal connected to the output terminal of the first switch and a second terminal connected to each pixel structured in a matrix, the plurality of fourth switches switching to supply the predetermined source voltage to or discharge energy from pixels selected according to the predetermined switching sequence.

8. The energy recovery apparatus of claim 7, wherein each of the first and fourth switches is a MOSFET switch.

9. The energy recovery apparatus of claim 8, wherein the MOSFET switch comprises a body diode between a drain and a source.

10. The energy recovery apparatus of claim 1, wherein the second closed circuit comprises:

a fouxth switch, which permits a flow therethrough of current that is discharged from pixels structured in a matrix;

a second switch, which is connected to the fourth switch and permits a flow therethrough of current that is discharged from the pixels structured in the matrix during an energy recovery mode;

the energy storage device, which is connected to the second switch and stores energy discharged from the pixels; and a third switch, which is connected to the energy storage device and ground and switches the energy storage device to ground in the energy recovery mode.

11. The energy recovery apparatus of claim 10, wherein each of the second, third, and fourth switches is a MOSFET switch.

12. The energy recovery apparatus of claim 11, wherein the MOSFET switch comprises a body diode between a drain and a source.

13. The energy recovery apparatus of claim 10, wherein the energy storage device comprises an inductor.

14. The energy recovery apparatus of claim 1, wherein the third closed circuit comprises a first diode, the energy storage device, a second diode, a fourth switch, pixels structured in a matrix, and ground, which are connected in sequence, and transfers the energy stored in the energy storage device to pixels among the pixels structured in the matrix and conducted by the fourth switch.

15. The energy recovery apparatus of claim 14, wherein the energy storage device comprises an inductor.

16. An energy recovery apparatus in a plasma display panel driving system including an address driving circuit that switches on a charge and discharge sequence of pixels during an address period, the energy recovery apparatus comprising a first switch, a second switch, an energy storage device, a third switch, a first diode, and a second diode, the first switch comprising an input terminal connected to a predetermined power supply and an output terminal connected to the address driving circuit, the second switch comprising a first terminal connected to the output terminal of the first switch and a second terminal connected to the energy storage device, and switching on or off current discharged from the pixels or energy transmitted through the first switch according to a predetermined sequence, the energy storage device connected between the second terminal of the second switch and a first terminal of the third switch, the third switch comprising the first terminal connected to the energy storage device and a second terminal connected to ground, the first diode being connected between the second terminal of the second switch and ground; and the second diode connected to the output terminal of the first switch and the first terminal of the third switch.

17. The energy recovery apparatus of claim 16, wherein the energy storage device comprises an inductor.

18. The energy recovery apparatus of claim 16, wherein each of the first, second, and third switches is a MOSFET switch.

19. The energy recovery apparatus of claim 16, wherein the predetermined sequence comprises:

a first mode, in which the second and third switches are turned off and the first switch is turned on so that pixels switched on by the address driving circuit are charged;

a second mode, in which the first, second, and third switches are turned on so that current flowing to the energy storage device is increased;

a third mode, in which the first switch is turned off and the second and third switches are turned on so that energy, which was charged in the pixels switched on by the address driving circuit, is recovered to the energy storage device;

a fourth mode, in which the first switch is turned off and the second and third switches are turned on, thereby forming a closed circuit including ground to which the address driving circuit is switched, so that the recovered energy is sustained; and a fifth mode, in which the first, second, and third switches are turned off so that the energy stored in the energy storage device is transferred to pixels through a path, composed of the first diode, the energy storage device, the second diode, the address driving circuit, and the pixels conducted by the address driving circuit, in order.

20. An energy recovery method for a plasma display panel driving system, comprising:

supplying a predetermined source voltage to pixels for conduction according to a predetermined switching sequence in a first mode;

increasing current flow in an energy storage device, while supplying the predetermined source voltage to the pixels, according to a predetermined switching sequence in a second mode;

recovering energy discharged from the pixels using the energy storage device according to a predetermined switching sequence in a third mode;

terminating a charge and discharge process of the pixels and sustaining the energy recovered by using the energy storage device according to a predetermined switching sequence in a fourth mode; and transferring the energy stored in the energy storage device to us pixels for conduction according to a predetermined switching sequence in a fifth mode.

21. The energy recovery method of claim 20, wherein the energy storage device comprises an inductor.

22. A method of designing an energy recovery apparatus in a plasma display panel driving system, wherein the energy recovery apparatus is designed such that a first closed circuit, which supplies a predetermined source voltage to pixels for conduction according to a predetermined switching sequence, is formed; a second closed circuit, which recovers energy discharged from the pixels that have been charged by the first closed circuit using a single energy storage device, is formed; and a third closed circuit, which transfers the energy stored in the single energy storage device to pixels for conduction according to the predetermined switching sequence, is formed.

23. The method of claim 22, wherein the energy recovery apparatus is designed such that a fourth closed circuit, which supplies current to the energy storage device for a predetermined period of time before energy recovery mode in the same direction as current flow during the energy recovery mode, is further formed.

24. The method of claim 22, wherein the energy recovery apparatus is designed such that a fifth closed circuit, which sustains the energy recovered in the energy storage device for a predetermined period of time before energy is supplied to the pixels for conduction, is further formed.

25. The method of claim 22, wherein the energy recovery apparatus is designed such that a fourth closed circuit, which supplies current to the energy storage device for a predetermined period of time before energy recovery mode in the same direction as current flows during the energy recovery mode, is further formed, and a fifth closed circuit, which sustains the energy recovered in the energy storage device for a predetermined period of time before the energy is supplied to the pixels for conduction, is further formed.

* * * * *